US007275605B2

(12) United States Patent
Smith et al.

(10) Patent No.: US 7,275,605 B2
(45) Date of Patent: Oct. 2, 2007

(54) ROTATABLE DRILL SHOE

(75) Inventors: Kenneth L. Smith, Katy, TX (US); Edward T. Cousins, Richmond, TX (US); Marc E. Leveque, Sugar Land, TX (US); Gary J. Collins, Richmond, TX (US)

(73) Assignee: ConocoPhillips Company, Houston, TX (US)

( * ) Notice: Subject to any disclaimer, the term of this patent is extended or adjusted under 35 U.S.C. 154(b) by 272 days.

(21) Appl. No.: 10/799,790

(22) Filed: Mar. 12, 2004

(65) Prior Publication Data

US 2005/0199426 A1 Sep. 15, 2005

(51) Int. Cl.
*E21B 7/20* (2006.01)
*E21B 17/07* (2006.01)

(52) U.S. Cl. ..... 175/57; 175/101; 175/321; 175/171

(58) Field of Classification Search ..... 175/57, 175/107, 171, 257, 101, 321
See application file for complete search history.

(56) References Cited

U.S. PATENT DOCUMENTS

| | | | | | |
|---|---|---|---|---|---|
| 2,359,717 | A | * | 10/1944 | Myers | 175/230 |
| 3,447,340 | A | * | 6/1969 | Garrett | 464/21 |
| RE26,745 | E | * | 12/1969 | Bottoms | 464/15 |
| 3,901,331 | A | | 8/1975 | Djurovic | |
| 3,933,209 | A | * | 1/1976 | Sweeney | 173/80 |
| 4,232,751 | A | * | 11/1980 | Trzeciak | 175/101 |
| 4,848,469 | A | * | 7/1989 | Baugh et al. | 166/382 |
| 5,168,942 | A | * | 12/1992 | Wydrinski | 175/50 |
| 5,662,180 | A | * | 9/1997 | Coffman et al. | 175/57 |
| 5,845,722 | A | * | 12/1998 | Makohl et al. | 175/101 |
| 5,881,827 | A | * | 3/1999 | Ikeda et al. | 175/259 |
| 5,950,742 | A | * | 9/1999 | Caraway | 175/57 |
| 5,957,225 | A | | 9/1999 | Sinor | |
| 6,073,708 | A | * | 6/2000 | Brown et al. | 175/93 |
| 6,106,200 | A | * | 8/2000 | Mocivnik et al. | 405/259.5 |
| 6,263,987 | B1 | | 7/2001 | Vail, III | |
| 6,368,021 | B1 | * | 4/2002 | Strong et al. | 405/228 |
| 6,412,574 | B1 | | 7/2002 | Wardley et al. | |
| 6,443,247 | B1 | * | 9/2002 | Wardley | 175/402 |
| 6,817,633 | B2 | * | 11/2004 | Brill et al. | 285/333 |
| 6,896,075 | B2 | * | 5/2005 | Haugen et al. | 175/57 |
| 6,899,186 | B2 | * | 5/2005 | Galloway et al. | 175/5 |
| 2004/0226751 | A1 | * | 11/2004 | McKay et al. | 175/57 |
| 2004/0245020 | A1 | * | 12/2004 | Giroux et al. | 175/61 |
| 2006/0021801 | A1 | * | 2/2006 | Hughes et al. | 175/385 |

FOREIGN PATENT DOCUMENTS

| | | | |
|---|---|---|---|
| SU | 1559089 | A1 * | 4/1990 |
| WO | WO 94738 | A1 | 12/2001 |

* cited by examiner

*Primary Examiner*—David Bagnell
*Assistant Examiner*—Shane Bomar
(74) *Attorney, Agent, or Firm*—Ryan N. Cross; Kameron D. Kelly

(57) ABSTRACT

A rotatable drilling shoe attachable to a section of casing that allows for drilling and casing of a well bore in a single trip. The drilling shoe includes a fixed section and a rotatable section that has a drillable bit attached thereto. The drilling shoe further includes a mechanism for inhibiting rotation of the rotatable section after the casing is cemented into place so that the drillable bit can be drilled out by a subsequent drilling operation.

36 Claims, 6 Drawing Sheets

ROTATABLE DRILL SHOE

BACKGROUND OF THE INVENTION

1. Field of the Invention

The present invention relates generally to an apparatus allowing for simultaneous drilling and casing of a subterranean well. In a further aspect, the invention relates to a rotatable drill shoe coupled with a section of casing and a method of drilling and completing a subterranean well using the same.

2. Description of the Prior Art

Conventional techniques of constructing oil and gas wells, especially deep sea wells, involve drilling a well bore using a string of drill pipe having a drill bit attached to the lower end thereof. As the drill string is advanced into the ground, it encounters different rock formations, some of which may be unstable. In order to minimize problems which may arise in connection with traversing these various formations, the drill bit is run to a desired depth and then the drill string is removed from the well bore. Next, casing is lowered into the well bore and cemented in place. Essentially, the casing acts as a lining within the well bore and prevents collapse of the well bore or loss of drilling fluids into the formations.

This conventional technique requires two separate trips in and out of the well bore in order to complete the well, ignoring any subsequent trips for increasing the depth of the well bore which may be required. Each trip into and out of the well bore can require hours or even days depending upon the depths involved and leads to costly nonproductive time. Combining these two trips into one would significantly reduce the time involved in well completion and costs associated therewith.

Attempts have been made to drill while running casing. These attempts have generally involved using a drill bit rigidly secured to the casing and then rotating the entire casing string in order to turn the drill bit. There are a number of problems associated with this method, especially in the context of deep sea drilling. In deep sea drilling, the casing has a subsea wellhead installed at the top thereof. Conventional drill string is run through the well head and is carried by the drilling rig. The rotation of the casing in the open water between the drilling rig and the mud line can create large stresses at the interface between the casing and the drill pipe. The rotation of the large casing used in deep sea wells in a relatively high water current may also cause vibrations or high excursions from the well center. Furthermore, when landing casing with a high pressure subsea wellhead installed into a low pressure wellhead, rotation may damage one or both wellheads.

OBJECTS AND SUMMARY OF THE INVENTION

It is, therefore, an object of the present invention to provide an apparatus and method of drilling and completing a well in a single trip, with or without rotation of the casing.

One aspect of the present invention concerns a drilling shoe configured to be coupled to a casing section. The drilling shoe comprises a fixed section adapted to be coupled to the casing section, and a rotatable section coupled to the fixed section. The drilling shoe is shiftable between a rotatable configuration and a locked configuration. The rotatable section is rotatable relative to the fixed section when the drilling shoe is in the rotatable configuration. The rotatable section is rotationally fixed relative to the fixed section when the drilling shoe is in the locked configuration.

Another aspect of the invention concerns a drilling apparatus coupled with a section of casing. The drilling apparatus comprises a drilling shoe that is selectively rotatable relative to the casing section and includes a drillable bit. The drilling shoe further includes a locking mechanism for preventing rotation of the shoe relative to the casing section so that the bit can be drilled out after the casing section is set.

Yet another aspect of the invention concerns a method comprising the steps of: (a) coupling a drilling shoe to an end of a casing section; (b) using the drilling shoe to drill a borehole in a subterranean formation by rotating a rotatable portion of the drilling shoe relative to the casing section; and (c) locking the drilling shoe so that relative rotation of the casing section and the rotatable portion is inhibited.

Still another aspect of the invention concerns a method of drilling and completing a well. The method comprises the steps of: (a) providing an apparatus comprising a section of casing, a drilling shoe, and a locking mechanism, with the drilling shoe being coupled to the section of casing and the drilling shoe including a drillable drill bit; (b) rotating the shoe relative to the section of casing to thereby drill a well bore to a desired depth; (c) cementing the casing section into place; and (d) drilling out at least a portion of the drillable bit by a subsequent drilling operation. The locking mechanism prevents rotation of the shoe relative to the section of casing during step (d).

Other aspects and advantages of the present invention will be apparent from the following detailed description of the preferred embodiments and the accompanying drawing figures.

BRIEF DESCRIPTION OF THE DRAWING FIGURES

Preferred embodiments of the present invention are described in detail below with reference to the attached drawing figures, wherein.

Figure 5:
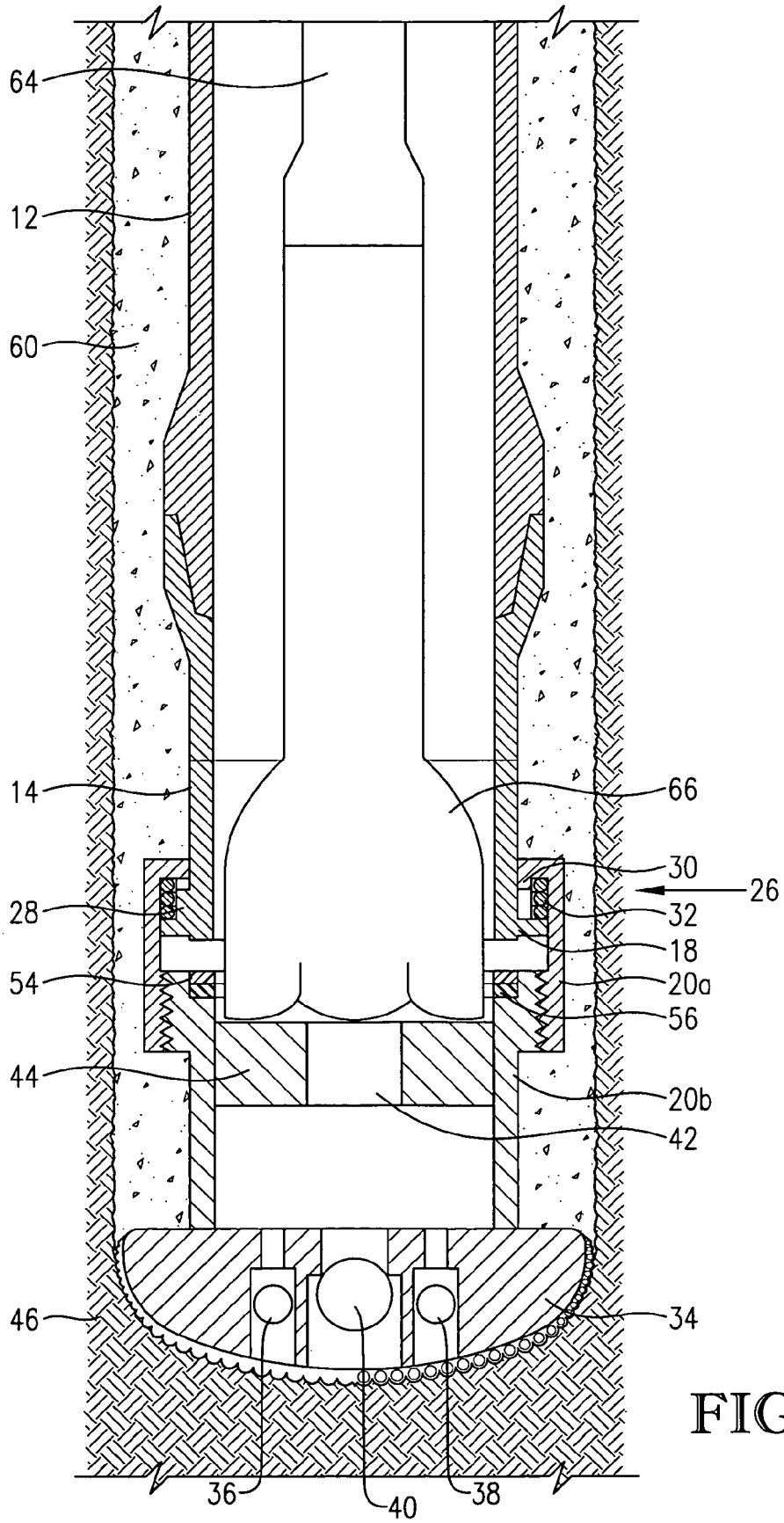
FIG. 5 is a cross-sectional view of a drilling shoe apparatus coupled with a section of casing showing the commencement of a subsequent drilling operation to drill out a portion of the drilling shoe.
Figure 6:
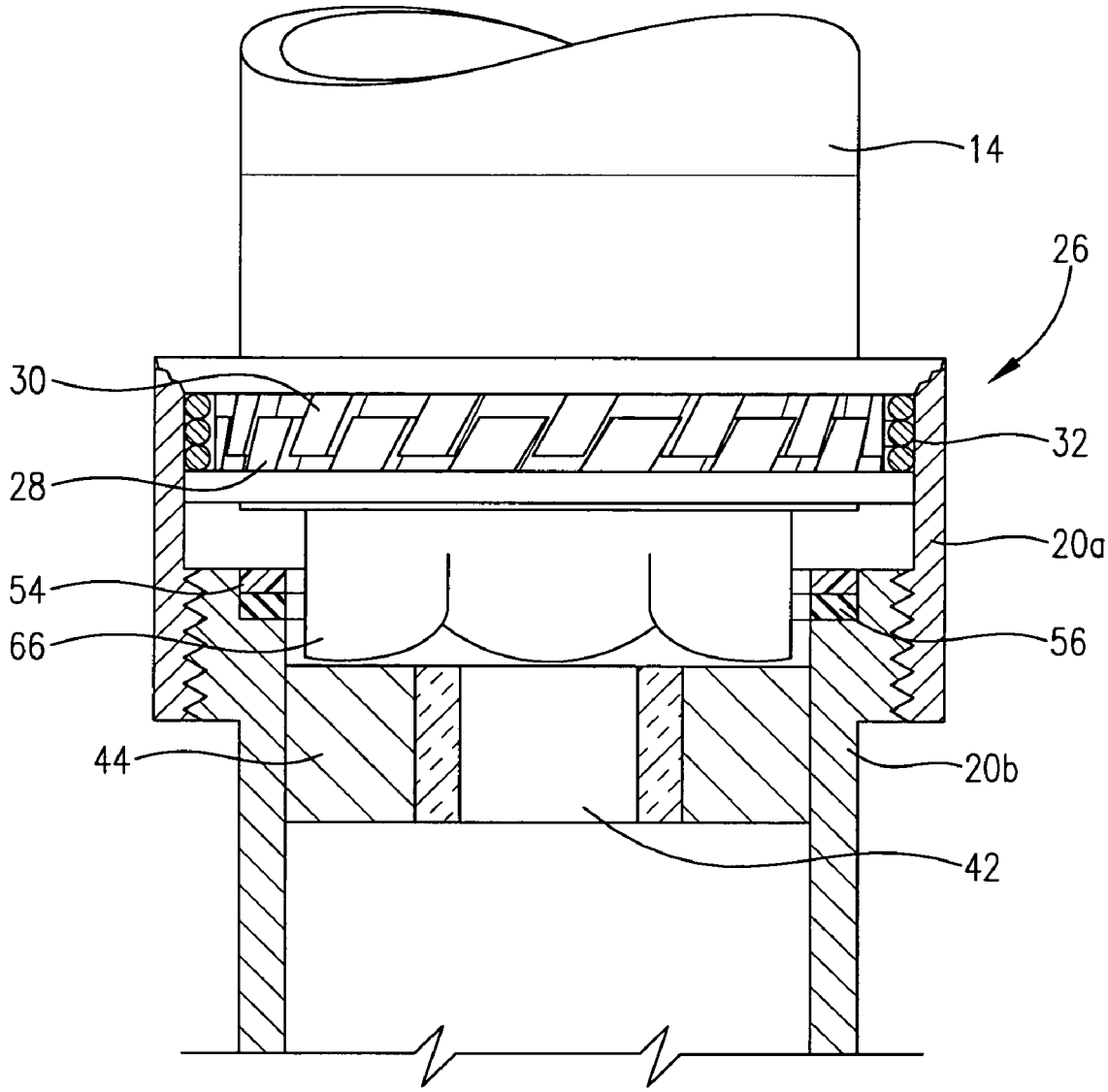
Figure 7:
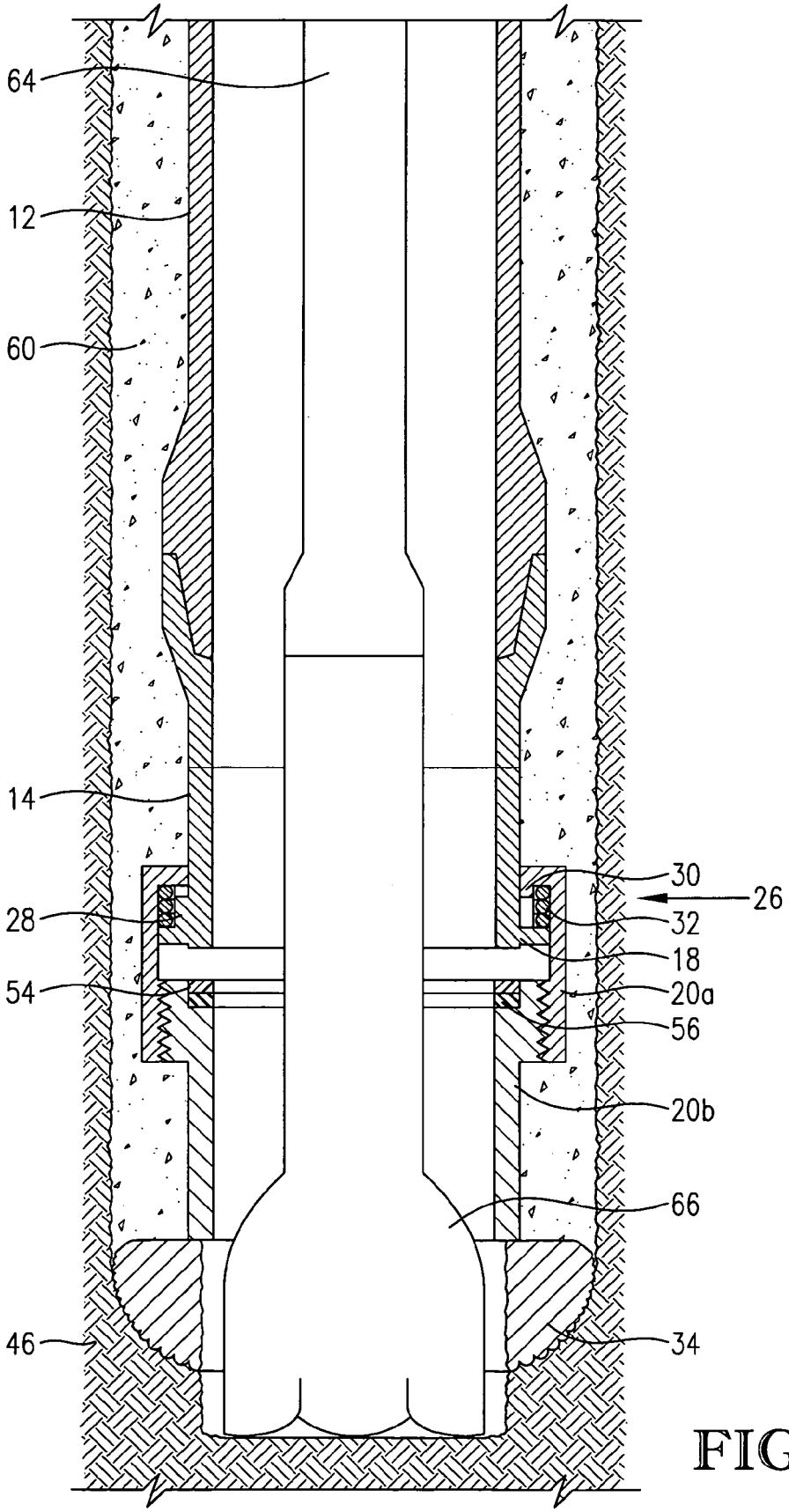

FIG. 6 is a close-up cross-sectional view of a portion of the drilling shoe apparatus of FIG. 5 showing the locking of the shoe to prevent rotation of the shoe relative to the casing section during the drill out operation; and FIG. 7 is a cross-sectional view of a drilling shoe apparatus coupled with a section of casing, the drilling shoe being completely penetrated and subsequent drilling operations continuing into the underlying subterranean formation.

DETAILED DESCRIPTION OF THE PREFERRED EMBODIMENT

Figure 1:
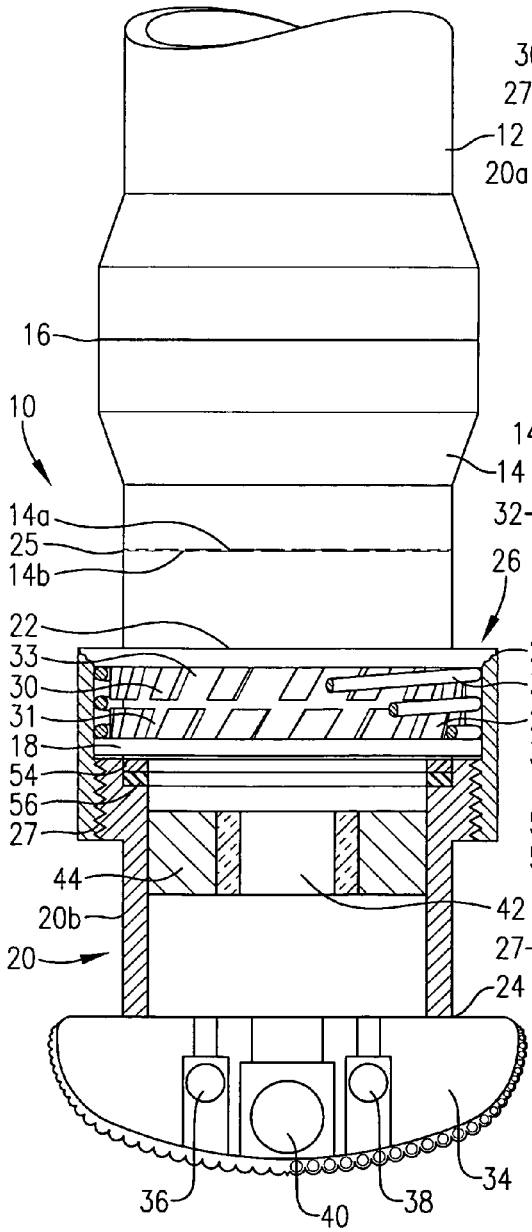
FIG. 1 is a side view of a drilling shoe apparatus coupled with a section of casing with portions of the drilling shoe being shown in cross-sectional view.
Figure 3:
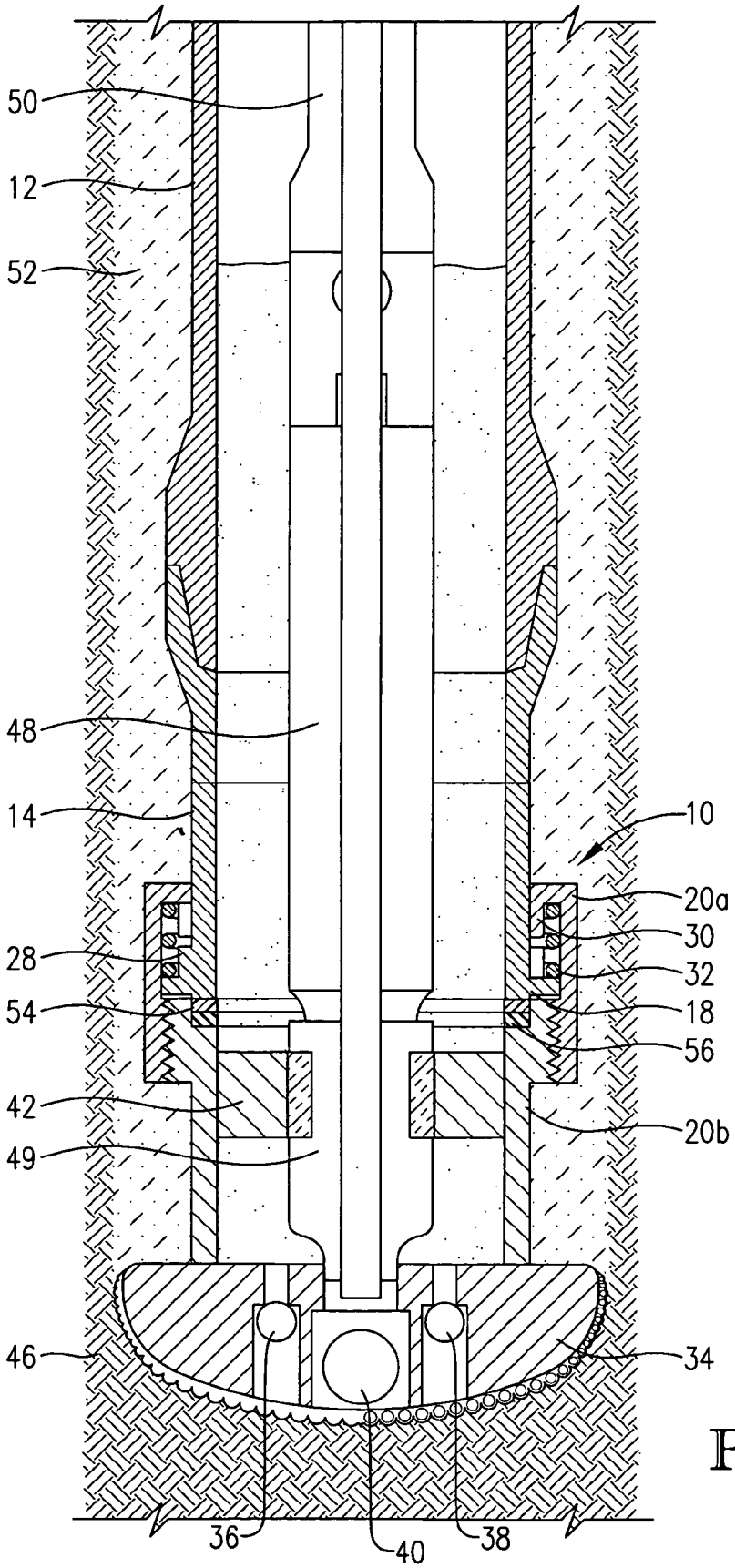
FIG. 3 is a cross-sectional view of a drilling shoe apparatus coupled with a casing section showing drilling in a subterranean formation.

Turning first to FIG. 1, a drilling shoe apparatus 10 attached to a section of casing 12 is shown. The same drilling shoe 10 is shown disassembled in FIG. 2. Drilling shoe 10 comprises a fixed section 14 having first and second fixed ends 16, 18 and a rotatable section 20 having first and second rotatable ends 22, 24. Fixed section 14 is telescopically intercoupled with rotatable section 20, that is, fixed section 14 is slidably received within rotatable section 20 so as to allow axial shifting of sections 14 and 20 relative to each other. First fixed end 16 is threadably coupled with casing section 12 (threading not shown) so as to prevent any rotation of fixed section 14 relative to casing section 12.

In order to provide easier assembly of drilling shoe 10, fixed section 14 comprises two portions 14*a*, 14*b* which are preferably welded together at seam 25. If another type of connection other than a weld seam is desired, portions 14*a* and 14*b* may be threadably coupled, preferably using a left-handed threading arrangement to prevent the connection from becoming loosened during operation of drilling shoe 10. Rotatable section 20 also comprises two portions, 20*a* and 20*b* for ease of assembly. Portions 20*a* and 20*b* each comprise complementary threading 27 for coupling the portions together. Threading 27 is preferably of a left-handed arrangement to prevent the backing off of portion 20*b* from portion 20*a* during operation of drilling shoe 10.

Drilling shoe 10 further comprises a locking mechanism 26 which includes two sets of interlockable projections or teeth 28, 30 and a spring 32, preferably a compression spring 32. Teeth 28 are attached to fixed section 14 and teeth 30 are attached to rotatable section 20. A plurality of recesses 31 are provided between teeth 28 on both fixed section 14, and a plurality of recesses 33 are provided between teeth 30 on rotatable section 20. Drilling shoe 10 is shiftable between a rotatable configuration (shown in FIG. 1) wherein teeth 28, 30 are spaced apart and a locked configuration (shown in FIG. 6) wherein teeth 28, 30 are interlocked. In the locked configuration, teeth 28, 30 are received in recesses 31, 33 to prevent relative rotation of fixed section 14 and rotatable section 20. Essentially, in the locked configuration, teeth 28, 30 are interlocked. Teeth 28, 30 are removed from recesses 31, 33 when drilling shoe 10 is in the rotatable configuration to thereby permit relative rotation of fixed section 14 and rotatable section 20.

In shifting between locked and rotatable configurations, rotatable section 20 is axially shifted relative to fixed section 14. Spring 32 is disposed between at least a portion of rotatable section 20 and at least a portion of fixed section 14 and normally biases drilling shoe 10 toward the rotatable configuration.

Drillable bit 34 is rigidly coupled (preferably welded) with second rotatable end 24 and presents a diameter that is greater than the widest diameter presented by drilling shoe 10 and casing section 12. As used here, "drillable bit" means that the bit is primarily constructed from a material that allows a second drill bit to drill through it. Suitable materials for constructing the drillable bit include cast aluminum, copper, mild steel, or brass alloy; however, any suitable soft material adapted to be drilled through with a standard earth drill bit may be used. By forming the drillable bit from a relatively soft material, the life of the second drill bit utilized to drill through the drillable bit is extended so as to improve drilling performance with the second drill bit.

Bit 34 comprises a plurality of valves formed therein for controlling fluid flow through the bit. Float valves 36, 38, and 40 are representative of these valves and allow for unidirectional flow of drilling fluid or cement through bit 34 during drilling and cementing operations, respectively.

Drilling shoe 10 also contains a drive section 42 which can be attached to a power source in order to facilitate powered rotation of rotatable section 20 relative to casing section 12. While any means known in the art for attaching a power source to drive section 42 may be used, the present embodiment employs a plurality of splines 44 which define a passage way through drive section 42 and into which the power source is received. Preferably, splines 44 are formed of an easily drilled material.

Figure 2:
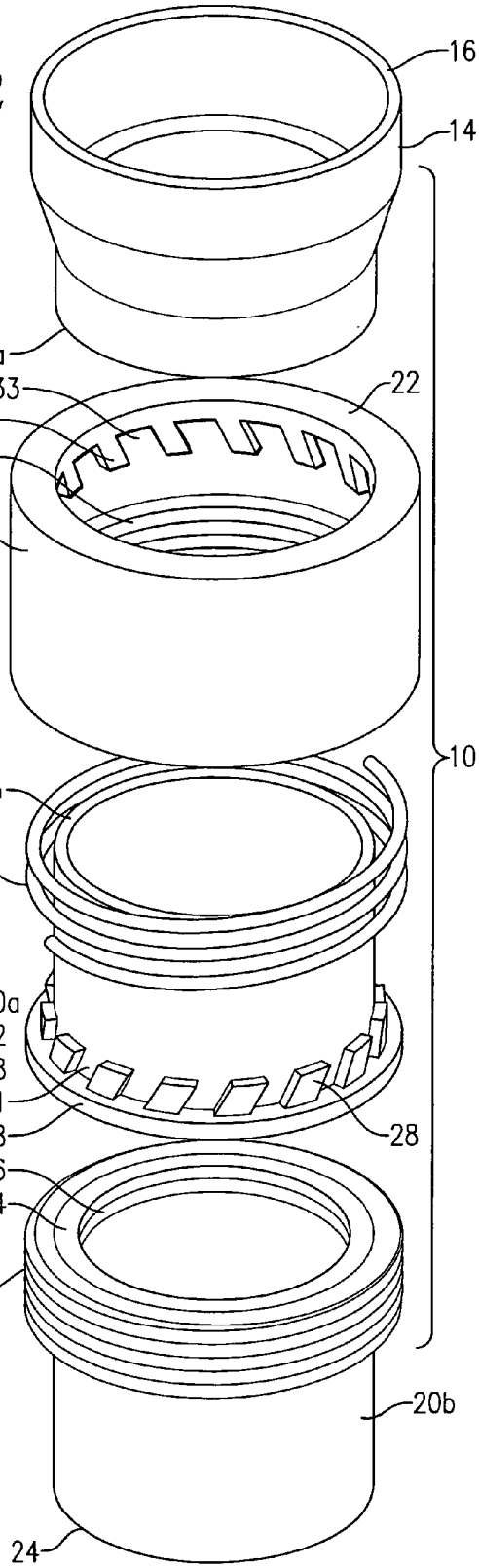
FIG. 2 is an isometric, exploded view of a drilling shoe apparatus without the drillable bit attached thereto.

FIG. 2 is an exploded view of drilling shoe 10 so that assembly thereof may be demonstrated. Bit 34 has been omitted for ease of illustration. Spring 32 is placed over the outside of fixed section portion 14*b*. Portion 14*b* is then fitted with portion 20*a* of rotatable section 20. Next, portions 14*a* and 14*b* of fixed section 14 are welded together to form weld seam 25. Finally rotatable section portion 20*b* is coupled with portion 20*a* via threads 27.

FIGS. 3-7 depict the use of drilling shoe 10 in the process of drilling, casing, and completing a subterranean well. Beginning with FIG. 3, drilling shoe 10 is attached to a casing section 12 and is in the process of drilling a bore hole in a subterranean formation 46. For purposes of the present description, the operation of drilling shoe 10 is made in the context of a deep sea oil or gas well. However, nothing in this description should be taken as limiting the operating scope of the present invention to only deep sea wells.

Drilling shoe 10 is undetachable from casing section 12 while shoe 10 and casing section 12 are positioned down hole in the well. As used herein, "undetachable" means that the shoe and casing are not capable of being separated without substantially damaging either the casing, the shoe, or both. Unless the entire string of casing 12 is removed from the well bore, drilling shoe 10 cannot be retrieved. Therefore, all drilling, cementing, and any subsequent drilling operations are performed without removing casing section 12 or drilling shoe 10 from the borehole.

A mud motor 48 is employed as the power source for drive section 42 and is attached to pipe string 50 which is run through casing 12. Mud motor 48 includes a drive shaft 49 that is complementary to and is releasably engaged with splines 44. Drilling fluid is circulated down pipe string 50, through mud motor 48, and exits bit 34 through float valve 40. The drilling fluid powers mud motor 48 which turns drive section 42 and causes bit 34 to rotate relative to casing section 12. Casing section 12 may remain substantially stationary with respect to formation 46 while bit 34 rotates or casing section 12 may be rotated simultaneously with rotation of bit 34. However, even if casing section 12 is rotated, bit 34 continues to rotate relative to the rotating casing section 12 because bit 34 is separately powered by mud motor 48.

The weight of casing section 12 maintains bit 34 in contact with formation 46 and seats second fixed end 18 against a bearing 54 and seal 56. Most importantly, the seating of end 18 along with the biasing action of spring 32 results in the separation of teeth 28, 30 thereby enabling rotation of rotatable section 20 relative to fixed section 14.

The back pressure of drilling fluid seats the floats of valves 36,38 to prevent flow of drilling fluid through the annulus of casing section 12. Instead, drilling fluid 52 (carrying particulate matter generated as a result of the drilling operation) is forced through the annulus created between formation 46 and casing section 12 and back up toward the surface or seabed. Drilling continues until the desired depth has been reached.

Figure 4:
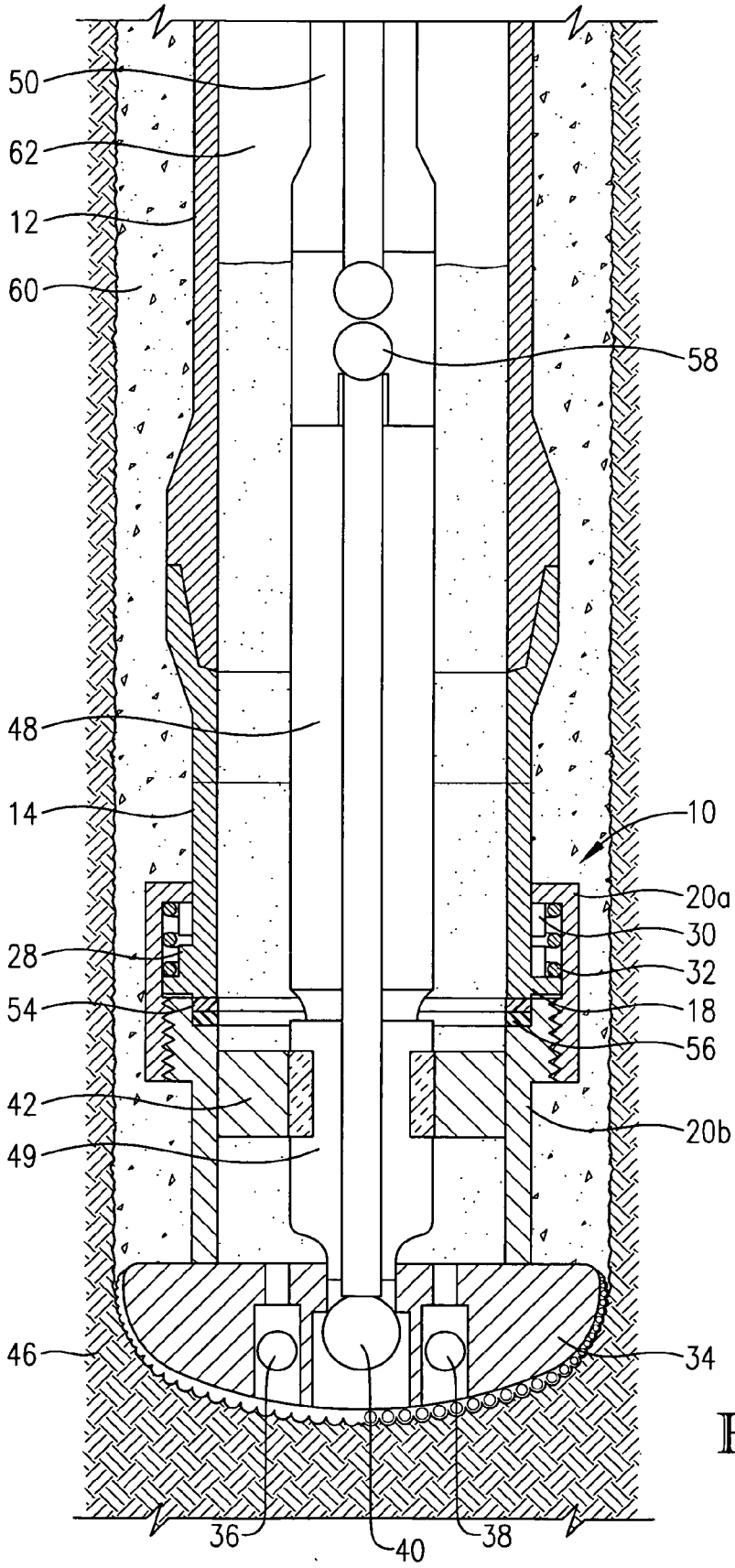
FIG. 4 is a cross-sectional view of a drilling shoe apparatus coupled with a casing section showing cementing of the casing section into place.

Once the desired depth is reached, casing section 12 is cemented into place as shown in FIG. 4. The flow of drilling fluid down string 50 is stopped and cement is pumped down into the well through string 50. At the same time, a bypass valve 58 is opened and cement 60 flows into the annulus of casing section 12, down through bit 34, and out float valves 36, 38 and into the annulus created between formation 46 and casing 12. Float valve 40 closes to prevent the back flow of cement into string 50. Casing 12 remains filled with sea water 62 above the level of bypass valve 58. Mud motor 48 can remain in drive section 42 during the cementing process or it can be picked up off the bottom. In either case some pack-off method inside casing section 12 will be required. The pack-off is normally incorporated in a standard subsea casing hanger running tool. Second fixed end 18 remains seated against bearing 54 and seal 56. This, along with the action of spring 32 keep teeth 28, 30 separated during the cementing process.

After casing section 12 is cemented in place, string 50 is removed from the annulus of casing section 12 and a drill string 64, having a conventional drill bit 66 attached thereto, is run down hole as shown in FIG. 5. Bit 66 contacts splines 44 of drive section 42 and exerts a force on splines 44 causing rotatable section 20 to axially shift downward thereby unseating second fixed end 18 from bearing 54 and seal 56. More importantly, teeth 28, 30 interlock so as to prevent rotation of rotatable section 20 relative to casing section 12. In order to continue drilling operations within the well, splines 44 and drillable bit 34 must be drilled out as shoe 10 cannot be retrieved from the well bore. The drilling out of these parts requires that rotatable section 20 refrains from rotation relative to drill string 64 and be mechanically locked relative to casing section 12. As used herein, "mechanically locked" means that movement of an otherwise moveable portion of an apparatus, such as rotatable section 20, is physically prevented due to the presence of an impeding body, such as fixed section 14. Therefore, it is essential that rotatable section 20 be axially shifted to a locked configuration with teeth 28,30 engaged to prevent rotation of section 20. Bit 66 is now ready to drill out splines 44 and drillable bit 34.

In certain instances, especially when the clearance beneath bit 34 is insufficient to allow axial shifting of rotatable section 20 and teeth 28, 30 to interlock, rotatable section 20 may initially rotate along with bit 66 during the drilling out step. In such case, drillable bit 34 will drill out underneath itself until teeth 28, 30 engage and lock section 20. Splines 44, drillable bit 34, and valves 36, 38, 40 are then drilled out by bit 66. Fluids may now be produced from subterranean formation 46 through drilling shoe 10.

FIG. 6 is a close-up view of locking mechanism 26 in the same configuration shown in FIG. 5. FIG. 6 clearly shows the compression of spring 32 resulting from the axial shifting of rotatable section 20 and that teeth 28, 30 are interlocked. Therefore, rotation of section 20 relative to fixed section 14 is prevented, and bit 66 can drill out splines 44 and drillable bit 34.

Finally, FIG. 7 shows that bit 66 has completely drilled through drillable bit 34 and continues to drill into formation 46.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A drilling shoe configured to be coupled to a casing section, said drilling shoe comprising:

a fixed section adapted to be coupled to the casing section; and a rotatable section coupled to the fixed section, said drilling shoe being shiftable between a rotatable configuration and a locked configuration, said rotatable section being rotatable relative to the fixed section when the drilling shoe is in the rotatable configuration, said rotatable section being rotationally fixed relative to the fixed section when the drilling shoe is in the locked configuration, said drilling shoe being shiftable from the rotatable configuration into the locked configuration by axially shifting at least one of the rotatable and fixed sections away from the other of the rotatable and fixed sections, said drilling shoe comprising an internal biasing mechanism for biasing the drilling shoe towards the rotatable configuration.

2. The drilling shoe of claim 1, said fixed and rotatable sections being telescopically intercoupled.

3. The drilling shoe of claim 1, said fixed section having first and second fixed ends, said rotatable section having first and second rotatable ends, said first fixed end being configured to be coupled to the casing section, said second fixed end and said first rotatable end being coupled to one another.

4. The drilling shoe of claim 3, one of said second fixed end and said first rotatable end presenting a projection, the other of said second fixed end and said first rotatable end presenting a recess, said projection being received in said recess when the drilling shoe is in the locked configuration to thereby prevent relative rotation of the fixed and rotatable sections, said projection being removed from the recess when the drilling shoe is in the rotatable configuration to thereby permit relative rotation of the fixed and rotatable sections.

5. The drilling shoe of claim 3, said rotatable section including a drillable drill bit rigidly coupled to the second rotatable end.

6. The drilling shoe of claim 5, said drill bit including a valve for controlling fluid flow therethrough.

7. The drilling shoe of claim 1, said internal biasing mechanism comprising a compression spring disposed between at least a portion of the fixed section and at least a portion of the rotatable section.

8. The drilling shoe of claim 1, said rotatable section including an internal drive member defining a splined opening.

9. The drilling shoe of claim 1, said fixed section being threadably coupled to the casing section.

10. A drilling apparatus coupled with a section of casing, said drilling apparatus comprising:

a drilling shoe comprising a fixed section and a rotatable section, said rotatable section being selectively rotatable relative to the casing section, said shoe including a drillable bit; and a locking mechanism for preventing rotation of the rotatable section relative to the casing section so that the bit can be drilled out after the casing section is set, said locking mechanism comprising two sets of interlockable teeth, one of said sets attached to the fixed section and the other of said sets attached to the rotatable section, said interlockable teeth being biased apart during rotation of the rotatable section relative to the casing, said interlockable teeth being shiftable from an unlocked configuration to a locked configuration by axially shifting at least one of the fixed and rotatable sections away from the other of the fixed and rotatable sections.

11. The apparatus of claim 10, said shoe being undetachable from the casing while the casing and the shoe are positioned down hole.

12. The apparatus of claim 10, said teeth being unlocked during rotation of the rotatable section relative to the casing and interlocked during drilling out of the bit after the casing section is set.

13. The apparatus of claim 10, said locking mechanism further including a spring biasing the teeth apart during rotation of the rotatable section relative to the casing.

14. The apparatus of claim 10, said shoe including a drive section for powered rotation of the rotatable section relative to the casing.

15. A drilling apparatus coupled with a section of casing, said drilling apparatus comprising:

a drilling shoe comprising a fixed section and a rotatable section, said rotatable section being selectively rotatable relative to the casing section, said rotatable section including a drillable bit; and a locking mechanism for preventing rotation of the rotatable section relative to the casing section so that the bit can be drilled out after the casing section is set, said locking mechanism being shiftable from an unlocked configuration to a locked configuration by axially shifting at least one of the fixed and rotatable sections away from the other of the fixed and rotatable sections, said shoe including a drive section for powered rotation of the rotatable section relative to the casing, said drive section comprising a plurality of splines and a complementary drive shaft configured for releaseable engagement with the splines.

16. The apparatus of claim 15, said apparatus further including a mud motor for powering the drive shaft.

17. The apparatus of claim 10, said drillable bit including first and second valves for controlling the flow of fluid therethrough.

18. A method comprising the steps of:

(a) coupling a drilling shoe to an end of a casing section, said drilling shoe including a non-rotatable portion and a rotatable portion;

(b) using the drilling shoe to drill a borehole in a subterranean formation by rotating the rotatable portion of the drilling shoe relative to the casing section; and (c) after drilling the wellbore to the desired depth, locking the drilling shoe so that relative rotation of the casing section and the rotatable portion is inhibited, wherein said locking is facilitated by axially shifting at least one of the rotatable and non-rotatable portions away from the other of the rotatable and non-rotatable portions.

19. A method comprising the steps of:

(a) coupling a drilling shoe to an end of a casing section, said drilling shoe including a non-rotatable portion and a rotatable portion;

(b) using the drilling shoe to drill a borehole in a subterranean formation by rotating the rotatable portion of the drilling shoe relative to the casing section;

(c) locking the drilling shoe so that relative rotation of the casing section and the rotatable portion is inhibited, wherein said locking is facilitated by axially shifting at least one of the non-rotatable and rotatable portions away from the other of the non-rotatable and rotatable portions; and (d) while the drilling shoe is locked, drilling out the drilling shoe to thereby permit fluid flow therethrough.

20. The method of claim 19, said rotatable portion of the drilling shoe including a drill bit, step (b) including using the drill bit to drill the borehole, step (d) including drilling out the drill bit.

21. The method of claim 19; and (e) subsequent to step (b) and prior to step (d), cementing the casing by passing cement downwardly through the casing section and out of the drilling shoe.

22. The method of claim 21, steps (b) and (e) being performed without removing the casing section or the drilling shoe from the borehole.

23. The method of claim 21; and (f) producing fluids from the subterranean formation through the drilling shoe.

24. The method of claim 23, steps (b), (c), (d), (e), and (f) being performed without removing the casing section or the drilling shoe from the borehole.

25. The method of claim 18, said non-rotatable portion being telescopically intercoupled with the rotatable portion.

26. The method of claim 18, step (c) including mechanically locking the rotatable portion of the drilling shoe relative to the casing section.

27. The method of claim 26, said non-rotatable section having first and second fixed ends, said rotatable section having first and second rotatable ends, one of said second fixed end and said first rotatable end presenting a projection, the other of said second fixed end and said first rotatable end presenting a recess, step (c) including inserting the projection into the recess.

28. The method of claim 18, step (b) being performed while simultaneously rotating the casing.

29. A method of drilling and completing a well comprising the steps of:

(a) providing an apparatus comprising a section of casing, a drilling shoe, and a locking mechanism, said drilling shoe comprising a fixed section coupled to the section of casing and a rotatable section rotatable relative to the section of casing, said rotatable section including a drillable drill bit;

(b) rotating said rotatable section relative to the section of casing to thereby drill a well bore to a desired depth;

(c) cementing said section of casing into place;

(d) axially shifting at least one of the fixed and rotatable sections away from the other of the fixed and rotatable sections to thereby lock said locking mechanism; and (e) while said locking mechanism is locked, drilling out at least a portion of said drillable bit by a subsequent drilling operation, said locking mechanism preventing rotation of the rotatable section relative to the section of casing during step (e).

30. The method of claim 29, said fixed section being telescopically intercoupled with said rotatable section.

31. The method of claim 30, said locking mechanism comprising two sets of interlockable teeth, one of said sets attached to the fixed section and the other of said sets attached to the rotatable section.

32. The method of claim 31, step (d) causing said teeth to interlock, said teeth being unlocked during step (b) and interlocked during step (e).

33. The method of claim 31, said locking mechanism further including a spring biasing the teeth apart during step (b).

34. The method of claim 29, said drillable bit including first and second valves for controlling the flow of fluid therethrough.

35. The method of claim 29, step (b) being performed while simultaneously rotating the casing.

36. A drilling shoe configured to be coupled to a casing section, said drilling shoe comprising:

a fixed section adapted to be coupled to the casing section; and a rotatable section coupled to the fixed section, said drilling shoe being shiftable between a rotatable configuration and a locked configuration, said rotatable section being rotatable relative to the fixed section when the drilling shoe is in the rotatable configuration, said rotatable section being rotationally fixed relative to the fixed section when the drilling shoe is in the locked configuration, wherein axial shifting at least one of said fixed and rotatable sections away from the other of said fixed and rotatable sections causes the drilling shoe to shift from the rotatable configuration to the locked configuration.

* * * * *